US008271290B2

(12) United States Patent
Breebaart

(10) Patent No.: US 8,271,290 B2
(45) Date of Patent: Sep. 18, 2012

(54) ENCODING AND DECODING OF AUDIO OBJECTS

(75) Inventor: Dirk Jeroen Breebaart, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 761 days.

(21) Appl. No.: 12/441,538

(22) PCT Filed: Sep. 17, 2007

(86) PCT No.: PCT/IB2007/053748

§ 371 (c)(1),
(2), (4) Date: Mar. 17, 2009

(87) PCT Pub. No.: WO2008/035275

PCT Pub. Date: Mar. 27, 2008

(65) Prior Publication Data

US 2009/0326960 A1 Dec. 31, 2009

(30) Foreign Application Priority Data

Sep. 18, 2006 (EP) ..... 06120819
Nov. 10, 2006 (EP) ..... 06123799

(51) Int. Cl.
*G10L 19/00* (2006.01)
*H04R 5/00* (2006.01)

(52) U.S. Cl. ..... 704/500; 704/501; 381/2; 381/19

(58) Field of Classification Search ..... None
See application file for complete search history.

(56) References Cited

U.S. PATENT DOCUMENTS 7,680,288 B2 * 3/2010 Melchior et al. ..... 381/119
7,809,453 B2 * 10/2010 Reichelt et al. ..... 700/94
7,974,422 B1 * 7/2011 Ho et al. ..... 381/119
2003/0026441 A1 2/2003 Faller
2003/0035553 A1 2/2003 Baumgarte
2007/0203598 A1 * 8/2007 Seo et al. ..... 700/94
2008/0049943 A1 * 2/2008 Faller et al. ..... 381/17
2009/0067634 A1 * 3/2009 Oh et al. ..... 381/17
2009/0177479 A1 * 7/2009 Yoon et al. ..... 704/500

OTHER PUBLICATIONS

Breebaart et al., "MPEG Spatial Audio Coding / MPEG Surround: Overview and Current Status", Audio Engineering Society Convention Paper, Presented at the 119th Convention, Oct. 7-10, 2005.*

(Continued)

*Primary Examiner* — Brian Albertalli

(57) ABSTRACT

An audio system comprises an encoder (209) which encodes audio objects in an encoding unit (403) that generates a down-mix audio signal and parametric data representing the plurality of audio objects. The down-mix audio signal and parametric data is transmitted to a decoder (215) which comprises a decoding unit (301) which generates approximate replicas of the audio objects and a rendering unit (303) which generates an output signal from the audio objects. The decoder (215) furthermore contains a processor (501) for generating encoding modification data which is sent to the encoder (209). The encoder (209) then modifies the encoding of the audio objects, and in particular modifies the parametric data, in response to the encoding modification data. The approach allows manipulation of the audio objects to be controlled by the decoder (215) but performed fully or partly by the encoder (209). Thus, the manipulation may be performed on the actual independent audio objects rather than on approximate replicas thereby providing improved performance.

30 Claims, 7 Drawing Sheets

OTHER PUBLICATIONS

ISO/IEC JTC 1/SC 29/WG 11 N8329, "Concepts of Object-Oriented Spatial Audio Coding", Jul. 2006.*

Faller et al., "Binaural Cue Coding—Part II: Schemes and Applications", IEEE Transactions on Speech and Audio Processing, vol. 11, No. 6, Nov. 2003.*

Faller, "Parametric Joint-Coding of Audio Sources", Audio Engineering Society Convention Paper 6752, Presented at the 120th Convention, May 20-23, 2006.*

Breebaart, J. et al "MPEG Spatial Audio Coding/MPEG Surround: Overview and Current Status" Audio Engineering Society, Oct. 2005, pp. 1-17.

* cited by examiner

ENCODING AND DECODING OF AUDIO OBJECTS

FIELD OF THE INVENTION

The invention relates to encoding and decoding of audio objects and in particular, but not exclusively to manipulation of audio objects of a down-mix spatial signal.

BACKGROUND OF THE INVENTION

Digital encoding of various audio signals has become increasingly important over the last decades as digital signal representation and communication increasingly has replaced analogue representation and communication.

In the last decade there has been a trend towards multi-channel audio and specifically towards spatial audio extending beyond conventional stereo signals. For example, traditional stereo recordings only comprise two channels whereas modern advanced audio systems typically use five or six channels, as in the popular 5.1 surround sound systems. This provides for a more involved listening experience where the user may be surrounded by sound sources.

Various techniques and standards have been developed for communication of such multi-channel signals. For example, six discrete channels representing a 5.1 surround system may be transmitted in accordance with standards such as the Advanced Audio Coding (AAC) or Dolby Digital standards.

However, in order to provide backwards compatibility, it is known to down-mix the higher number of channels to a lower number and specifically it is frequently used to down-mix a 5.1 surround sound signal to a stereo signal allowing a stereo signal to be reproduced by legacy (stereo) decoders and a 5.1 signal by surround sound decoders.

One example is the MPEG Surround backwards compatible coding method standardized by the Moving Pictures Experts Group (MPEG). In such a system, a multi-channel signal is down-mixed into a stereo signal and the additional signals are encoded by parametric data in the ancillary data portion allowing an MPEG Surround multi-channel decoder to generate a representation of the multi-channel signal. A legacy mono or stereo decoder will disregard the ancillary data and thus only decode the mono or stereo down-mix.

Thus, in (parametric) spatial audio (en)coders, parameters are extracted from the original audio signal so as to produce an audio signal having a reduced number of channels, for example only a single channel, plus a set of parameters describing the spatial properties of the original audio signal. In (parametric) spatial audio decoders, the spatial properties described by the transmitted spatial parameters are used to recreate the original spatial multi-channel signal.

Recently, techniques for distribution of individual audio objects which can be processed and manipulated at the receiving end have attracted significant interest. For example, within the MPEG framework, a work item is started on object-based spatial audio coding. The aim of this work item is to explore new technology and reuse of current MPEG Surround components and technologies for the bit rate efficient coding of multiple sound sources or objects into a number of down-mix channels and corresponding spatial parameters. Thus, the intention is to use similar techniques as used for down-mixing of spatial (surround) channels to fewer channels to down-mix independent audio objects into a smaller number of channels.

In object oriented audio systems, the decoder can provide discrete positioning of these sources/objects and adaptation to various loudspeaker setups as well as binaural rendering.

Additionally, user interaction can be used to control repositioning/panning of the individual sources on the reproduction side.

In other words, the aim of the research is to encode multiple audio objects in a limited set of down-mix channels accompanied by parameters. At the decoder side, users can interact with the content for example by repositioning the individual objects. As a specific example, a number of individual instruments may be encoded and distributed as audio objects thereby allowing a user receiving the encoded data to independently position the individual instruments in the sound image.

FIG. 1 illustrates an example of an object oriented audio encoder and decoder in accordance with the prior art. In the example, a set of audio objects ($O_1$ to $O_4$) are encoded in an object-oriented encoder 101 which generates a down-mix signal and object parameters. These are transmitted to the object oriented decoder 103 which generates approximate copies of the audio object signals using the transmitted object parameters.

Subsequently, a rendering element 105 generates the output signal having the desired characteristics. For example, the rendering element 105 can position the objects at sound source positions indicated by the user, for example using a panning law. The output signal configuration is flexible. For example, if the output signal is mono, the user can still manipulate the relative loudness/volume of each object. In a stereo output signal configuration, a simple panning law can be applied in order to position each object at a desired position. Obviously, for a multi-channel output configuration, the flexibility is even larger.

However, although the system can provide advantageous performance, it also has a number of disadvantages. For example, in many cases the reproduced quality is suboptimal and a completely free and independent manipulation of the individual audio objects is not possible. Specifically, the down-mix of the encoder is generally not completely reversible at the decoder which accordingly can only generate approximations of the original audio objects. Thus, the decoder is not able to fully reconstruct the individual object signals but can only estimate these according to perceptual criteria. This specifically results in cross-interference (crosstalk) between audio objects thereby resulting in the audio objects no longer being completely independent. As a result manipulations on one audio object affect the characteristics and perception of another object.

For example, one of the most important parameters that users typically would like to adjust is the relative volume of each audio object. However, if large volume adjustments are made this will result in considerable artifacts and undesirable crosstalk resulting in noticeable quality degradation.

Hence, an improved system for audio object encoding/decoding would be advantageous and in particular a system allowing increased flexibility, improved quality, facilitated implementation and/or improved performance would be advantageous.

SUMMARY OF THE INVENTION

Accordingly, the Invention seeks to preferably mitigate, alleviate or eliminate one or more of the above mentioned disadvantages singly or in any combination.

According to a first aspect of the invention there is provided an encoder for encoding audio objects, the encoder comprising: means for receiving a plurality of audio objects; encoding means for encoding the plurality of audio objects in a number of audio signals and parametric data representing the plurality of audio objects relative to the number of audio signals, the parametric data comprising a set of object parameters for at least one of the different audio objects; means for receiving encoding modification data from a remote unit; and parameter means for determining the parametric data in response to the encoding modification data.

The invention may allow improved encoding of audio objects and may in particular allow an audio distribution system wherein an improved user experience can be achieved e.g. with improved individual user control of individual audio objects. The invention may allow improved control of characteristics of individual audio objects and may in particular reduce cross audio object interference degradation when manipulating audio objects. The encoder may allow efficient remote controlled manipulation while modifying the encoding modification data such that an object oriented decoder will decode the manipulated audio objects correctly. The invention may allow an improved distribution of audio object manipulation between an encoder and decoder thereby resulting in improved flexibility, performance and/or quality.

The encoding means may furthermore generate the number of audio signals in response to the encoding modification data. The object parameters may be intensity parameters e.g. indicating a relative intensity difference between different audio objects and/or an energy conversion factor between one or more of the audio signals and the audio objects. The object parameters may comprise parameters for individual frequency-time blocks.

According to an optional feature of the invention, the encoding means is arranged to generate the number of audio signals by a down-mix of the audio objects and the parameter means is arranged to modify a down-mix weight of at least one of the audio objects in response to the encoding modification data.

This may provide a highly efficient and/or high quality control of the relative volume of an audio object by a listener while reducing or eliminating the effect on other audio objects. A high performance individual audio object volume control may be achieved.

According to an optional feature of the invention, the parameter means is arranged to scale at least a first audio object in response to the encoding modification data and to modify object parameters for the first audio object in response to the scaling.

This may provide a highly efficient and/or high quality control of the relative volume of an audio object by a listener while reducing or eliminating the effect on other audio objects. A high performance individual audio object volume control may be achieved.

According to an optional feature of the invention, at least some of the encoding modification data is frequency specific and the parameter means is arranged to determine at least one object parameter in response to a frequency characteristic of the object parameter.

This may allow improved control of the listening experience and may in particular allow the frequency response of the audio to be manipulated by a listener. The frequency characteristics of individual objects may be individually and separately modified with reduced or eliminated effect on other audio objects. In particular, an efficient and/or high quality equalization of individual audio objects may be achieved.

According to an optional feature of the invention, the encoding means is arranged to modify at least one audio object in response to the encoding modification data prior to a down-mix of the audio objects to the number of audio signals.

The parameter means may be arranged to determine the parametric data in response to characteristics of the modified audio object(s). This may allow high performance and/or facilitated implementation.

According to an optional feature of the invention, the encoding means is arranged to generate the number of audio signals as a spatial down-mix.

This may allow improved performance in many embodiments and may in particular allow improved operation in association with encoders having no or limited rendering capability. The encoder may for example be arranged to render a spatial multi-channel signal comprising the audio objects and may specifically be arranged to generate a spatial binaural signal.

According to an optional feature of the invention, the encoding means is arranged to modify in response to the encoding modification data at least one characteristic selected from the group consisting of: a spatial location of at least one of the audio objects; a distance characteristic of at least one of the audio objects; a spatial rendering mode of the encoder, and a frequency characteristic of at least one of the audio objects.

This may allow improved performance and the parameters may in particular allow a listener to modify perceptually significant parameters of a rendered spatial signal.

According to an optional feature of the invention, each audio object is associated with a set of audio sources which are independent of audio sources of other audio objects.

The audio objects may be independent of each other. The audio objects may correspond to different and independent sound sources. Specifically, the audio objects may be different audio objects which are generated individually and separately from the other audio objects and without any specific relationship. For example, the audio objects may be individually recorded/capture musical instruments or voices.

The audio objects may be non-spatial audio objects. The audio objects may be simple sound sources with no associated spatial characteristics or information and in particular there may be no relative spatial relationship, knowledge or association between the audio objects.

According to an optional feature of the invention, the encoder is arranged to receive a first audio object from the remote unit and the means for receiving the encoding modification data is arranged to extract the encoding modification data from encoding data received for the first audio object.

For example, the encoding modification data may be embedded in a speech, music or other audio signal. The encoding modification data may specifically be embedded in ancillary or user data fields of an encoded audio signal received from the remote unit, such as e.g. an MPEG 4 bitstream. This may allow an efficient, backward compatible and low complexity communication of control data and may in particular be useful in systems employing two-way communications between a apparatus comprising the encoder and the remote unit.

According to an optional feature of the invention, the encoder is arranged to receive encoding modification data from a plurality of remote units and to generate different parametric data for the different remote units in response to receiving different encoding modification data from the different remote units.

This may allow improved operation and/or additional services in many embodiments. The encoding means may furthermore be arranged to generate different audio signals for the different remote units. Thus, the approach may allow e.g.

a centralized audio object encoder to customize the transmitted data to the requirements and preferences of the individual users of the remote units.

According to another aspect of the invention, there is provided a decoder for decoding audio objects, the decoder comprising: a receiver for receiving from an encoder a number of audio signals being a down-mix of a plurality of audio objects and parametric data representing the plurality of audio objects relative to the number of audio signals, the parametric data comprising a set of object parameters for at least one of the different audio objects; decoding means for decoding the audio objects from the number of audio signals in response to the parametric data; rendering means for generating a spatial multi-channel output signal from the audio objects; means for generating encoding modification data for the object encoder; and means for transmitting the encoding modification data to the object encoder.

The decoding means and rendering means may in some embodiments be combined and the spatial multi-channel output signal may be generated directly from the audio signals without explicitly generating the audio object. For example, a matrix multiplication may be applied to signal values of the audio signals to generate audio object signal values. A second matrix multiplication may then be applied to the audio object signal values to generate the spatial multi-channel audio signal values. Alternatively, the first and second matrix multiplication may be combined into a single matrix multiplication. Thus, a single matrix multiplication may be applied to the signal values of the audio signals to directly generate the spatial multi-channel audio signal values. Thus, the decoding of the audio objects may be implicit in the rendering/matrix multiplication and no explicit/direct generation of audio object values are necessary.

According to another aspect of the invention, there is provided a teleconference hub for supporting a teleconference between a plurality of communication units, the teleconference hub comprising: means for receiving a first plurality of speech signals from the plurality of communication units; encoding means for encoding for a first communication unit the first plurality of speech signals in a number of audio signals and parametric data representing the plurality of speech signals relative to the number of audio signals, the parametric data comprising a set of object parameters for at least one of the different speech signals; means for receiving encoding modification data from the first communication unit; and parameter means for determining the parametric data in response to the modification data; and means for transmitting the number of audio signals and parametric data to the first communication unit.

According to another aspect of the invention, there is provided a transmitter for transmitting audio signals, the transmitter comprising: means for receiving a plurality of audio objects; encoding means for encoding the plurality of audio objects in a number of audio signals and parametric data representing the plurality of audio objects relative to the number of audio signals, the parametric data comprising a set of object parameters for at least one of the different audio objects; means for receiving encoding modification data from a remote unit; and parameter means for determining the parametric data in response to the modification data.

According to another aspect of the invention, there is provided a receiver for receiving a scalable audio bit-stream, the receiver comprising: a receiver element for receiving from an encoder a number of audio signals being a down-mix of a plurality of audio objects and parametric data representing the plurality of audio objects relative to the number of audio signals, the parametric data comprising a set of object parameters for at least one of the different audio objects; decoding means for decoding the audio objects from the number of audio signals in response to the parametric data; rendering means for generating a spatial multi-channel output signal from the audio objects; means for generating encoding modification data for the object encoder; and means for transmitting the encoding modification data to the object encoder.

According to another aspect of the invention, there is provided a communication system for communicating audio signals, the communication system comprising: a transmitter comprising: means for receiving a plurality of audio objects, encoding means for encoding the plurality of audio objects in a number of audio signals and parametric data representing the plurality of audio objects relative to the number of audio signals, the parametric data comprising a set of object parameters for at least one of the different audio objects, and means for transmitting the number of audio signals and the parametric data to a receiver; and the receiver comprising: a receiver element for receiving from the transmitter the number of audio signals and the parametric data, decoding means for decoding the audio objects from the number of audio signals in response to the parametric data, rendering means for generating a spatial multi-channel output signal from the audio objects, means for generating encoding modification data for the encoding means, and means for transmitting the encoding modification data to the transmitter; and wherein the transmitter comprises means for receiving the encoding modification data from the receiver; parameter means for determining the parametric data in response to the encoding modification data.

According to another aspect of the invention, there is provided a method of encoding audio signals, the method comprising: receiving a plurality of audio objects; encoding the plurality of audio objects in a number of audio signals and parametric data representing the plurality of audio objects relative to the number of audio signals, the parametric data comprising a set of object parameters for at least one of the different audio objects; receiving encoding modification data from a remote unit; and determining the parametric data in response to the modification data.

According to another aspect of the invention, there is provided a method of decoding audio signals, the method comprising: receiving from an encoder a number of audio signals being a down-mix of a plurality of audio objects and parametric data representing the plurality of audio objects relative to the number of audio signals, the parametric data comprising a set of object parameters for at least one of the different audio objects; decoding the audio objects from the number of audio signals in response to the parametric data; generating a spatial multi-channel output signal from the audio objects; generating encoding modification data for the object encoder; and transmitting the encoding modification data to the object encoder.

According to another aspect of the invention, there is provided a method of transmitting audio signals, the method comprising: receiving a plurality of audio objects; encoding the plurality of audio objects in a number of audio signals and parametric data representing the plurality of audio objects relative to the number of audio signals, the parametric data comprising a set of object parameters for at least one of the different audio objects; receiving encoding modification data from a remote unit; determining the parametric data in response to the modification data, and transmitting the number of audio signals and parametric data.

According to another aspect of the invention, there is provided a method of receiving audio signals, the method comprising: receiving from an encoder a number of audio signals being a down-mix of a plurality of audio objects and parametric data representing the plurality of audio objects relative to the number of audio signals, the parametric data comprising a set of object parameters for at least one of the different audio objects; decoding the audio objects from the number of audio signals in response to the parametric data; generating a spatial multi-channel output signal from the audio objects; generating encoding modification data for the object encoder; and transmitting the encoding modification data to the object encoder.

According to another aspect of the invention, there is provided a method of transmitting and receiving audio signals, the method comprising: a transmitter (101) performing the steps of: receiving a plurality of audio objects, encoding the plurality of audio objects in a number of audio signals and parametric data representing the plurality of audio objects relative to the number of audio signals, the parametric data comprising a set of object parameters for at least one of the different audio objects, and transmitting the number of audio signals and the parametric data to a receiver; and the receiver performing the steps of: receiving from the transmitter the number of audio signals and the parametric data; decoding the audio objects from the number of audio signals in response to the parametric data; generating a spatial multi-channel output signal from the audio objects; generating encoding modification data for the encoding means; and transmitting the encoding modification data to the object encoder; and wherein the transmitter further performs the steps of: receiving the encoding modification data from the receiver, and determining the parametric data in response to the encoding modification data.

According to another aspect of the invention, there is provided a computer program product for executing the method described above.

According to another aspect of the invention, there is provided an audio recording device comprising an encoder as described above.

According to another aspect of the invention, there is provided an audio playing device comprising a decoder as described above.

These and other aspects, features and advantages of the invention will be apparent from and elucidated with reference to the embodiment(s) described hereinafter.

BRIEF DESCRIPTION OF THE DRAWINGS

Embodiments of the invention will be described, by way of example only, with reference to the drawings, in which.

DETAILED DESCRIPTION OF SOME EMBODIMENTS OF THE INVENTION

The following description focuses on embodiments of the invention applicable to audio object encoding and/or decoding for a teleconferencing application. However, it will be appreciated that the invention is not limited to this application but may be applied in many other applications including e.g. music audio distribution applications.

Figure 1:
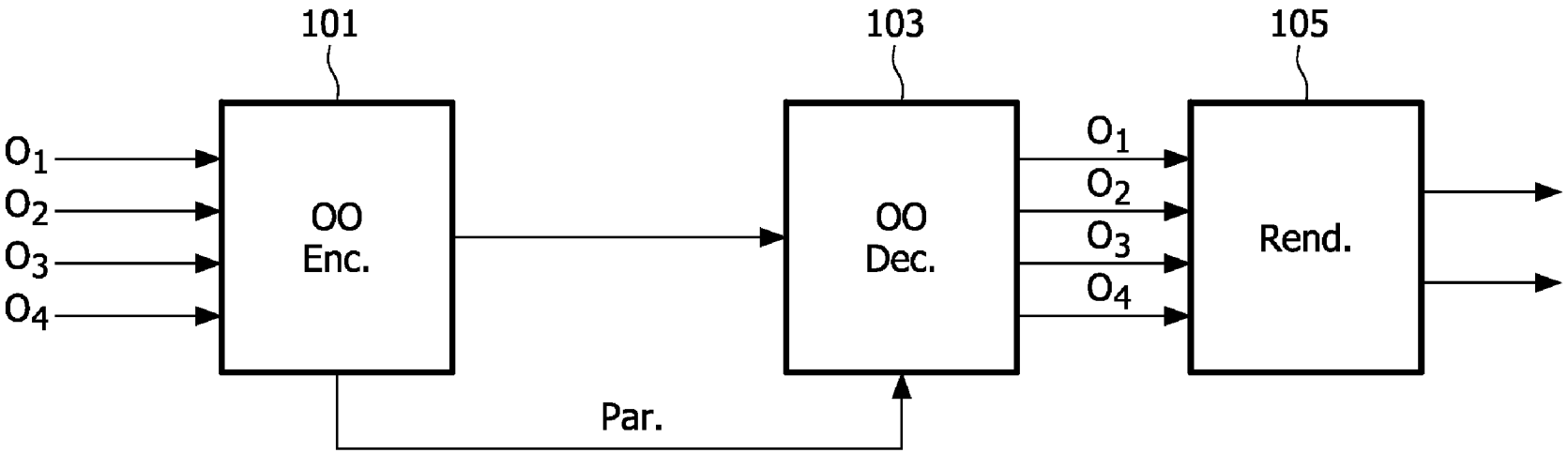
FIG. 1 Prior Art
FIG. 1 is an illustration of an audio system in accordance with the prior art.
Figure 2:
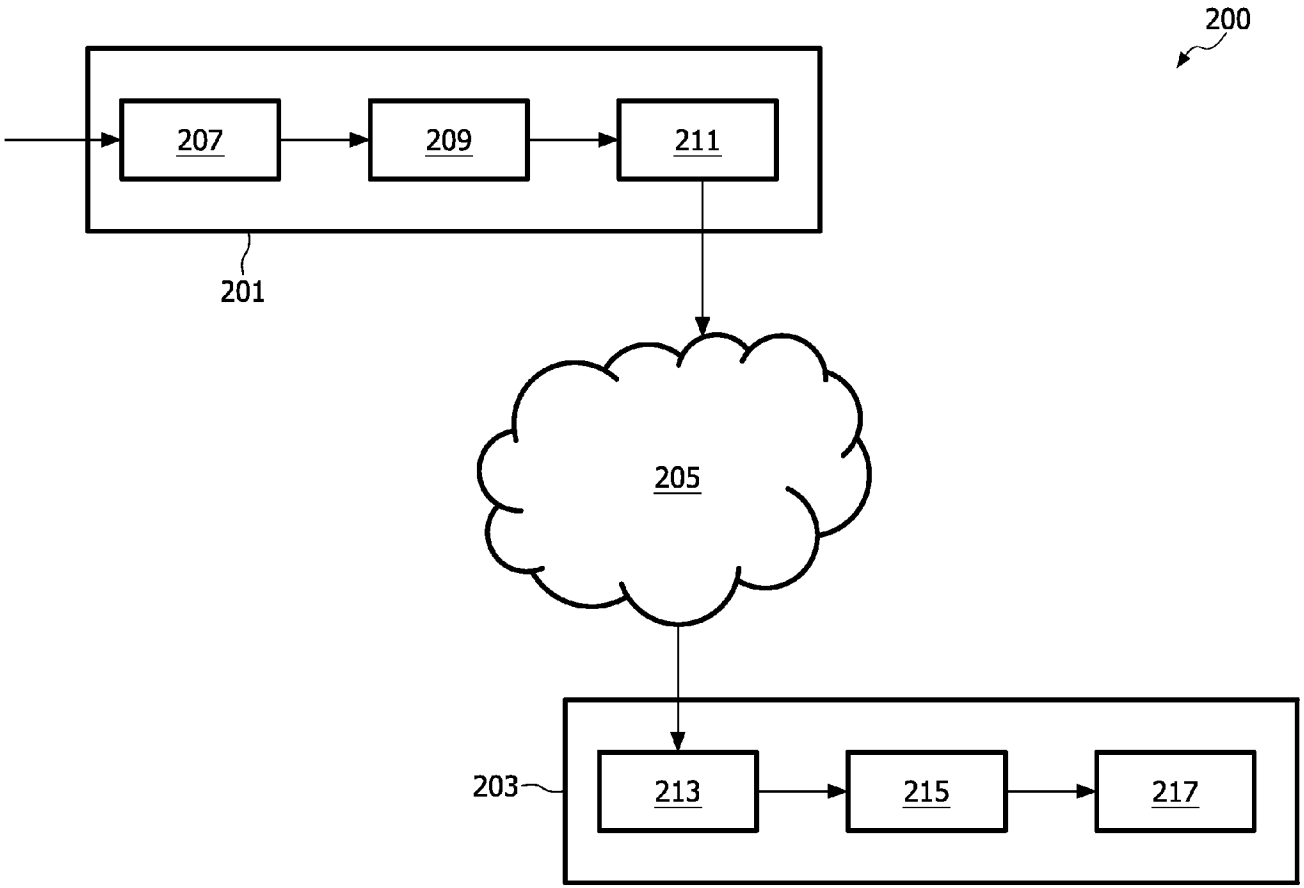
FIG. 2 illustrates an example of a communication system for communication of an audio signal in accordance with some embodiments of the invention.

FIG. 2 illustrates a communication system 200 for communication of an audio signal in accordance with some embodiments of the invention. The transmission system 200 comprises a transmitter 201 which is coupled to a receiver 203 through a network 205 which specifically may be the Internet.

In the specific example, the transmitter 201 is part of a teleconferencing hub. In a teleconferencing application, the speech signals of several far-end talkers are mixed in a teleconferencing hub. Then for each person in the teleconference, a mix of all signals except his/her own is transmitted to all receivers. Thus, the transmitter 201 can receive speech signals from a plurality of remote communication units taking part in the teleconference and can generate and distribute speech signals to the remote communication units. In the example, the receiver 203 is a signal player device which can generate a speech output to a participant of the conference call. Specifically, the receiver 203 is part of a remote communication unit such as telephone.

It will be appreciated that in other embodiments a transmitter and receiver may be used in other applications and for other purposes. For example, the transmitter 201 and/or the receiver 203 may be part of a transcoding functionality and may e.g. provide interfacing to other signal sources or destinations.

In the specific example, the transmitter 201 comprises a receiver 207 which receives speech signals from the remote communication units involved in the teleconference call. Each of the speech signals is treated as a separate and independent audio object.

The receiver 207 is coupled to the encoder 209 of FIG. 2 which is fed the individual speech audio objects and which encodes the audio objects in accordance with an encoding algorithm. The encoder 209 is coupled to a network transmitter 211 which receives the encoded signal and interfaces to the Internet 205. The network transmitter may transmit the encoded signal to the receiver 203 through the Internet 205.

The receiver 203 comprises a network receiver 213 which interfaces to the Internet 205 and which is arranged to receive the encoded signal from the transmitter 201.

The network receiver 213 is coupled to a decoder 215. The decoder 215 receives the encoded signal and decodes it in accordance with a decoding algorithm. Specifically, the decoder 215 is an object oriented decoder which can decode the individual audio objects and render an audio output signal based on the decoded audio objects.

In the specific example where a signal playing function is supported, the receiver 203 further comprises a signal player 217 which receives the decoded audio signal from the decoder 215 and presents this to the user. Specifically, the signal player 217 may comprise a digital-to-analog converter, amplifiers and speakers as required for outputting the decoded audio signal.

Figure 3:
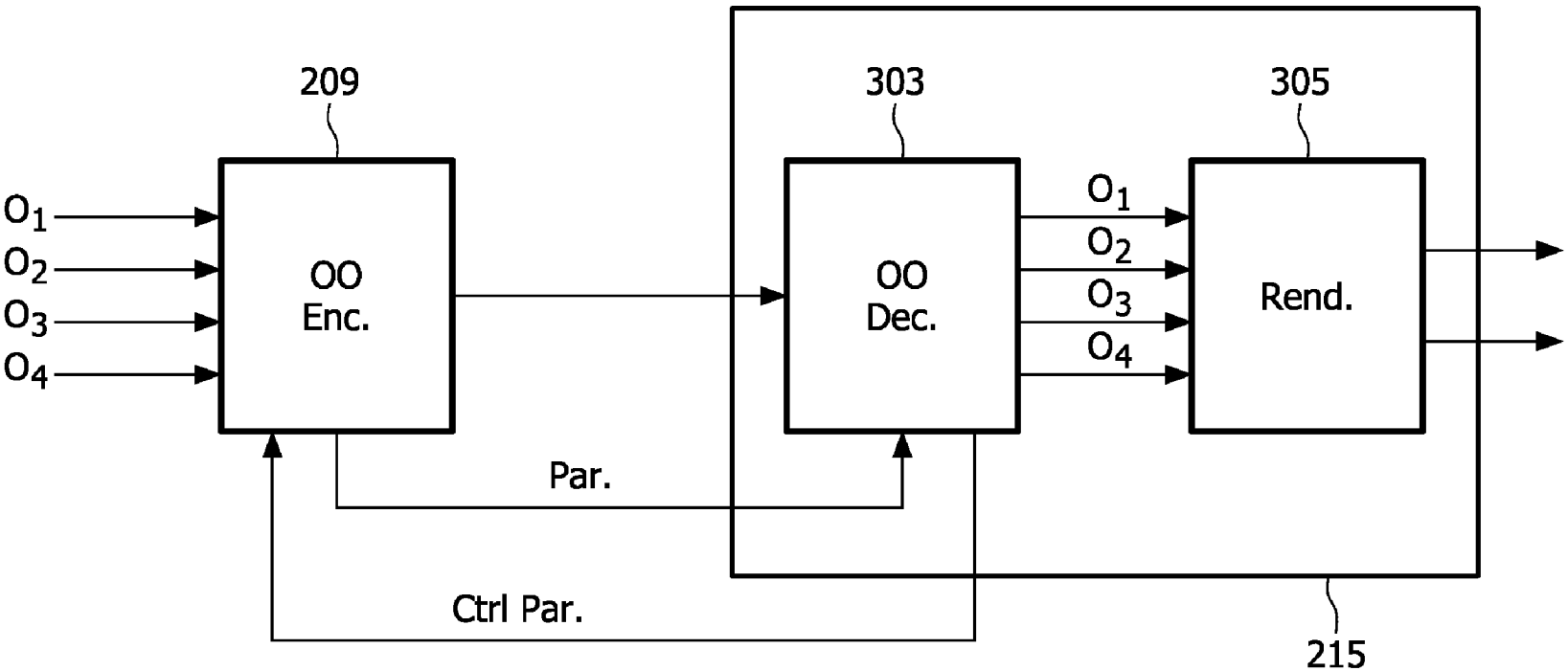
FIG. 3 illustrates an interaction between an encoder and a decoder in accordance with some embodiments of the invention.

FIG. 3 illustrates the interaction between the encoder 209 and the decoder 215 in more detail.

As illustrated, the object oriented encoder 209 receives a plurality of audio objects from the receiver 207. The audio objects are individual sound signals that are independent of each other and which specifically correspond to individual and independent sound sources. In some embodiments, the audio objects may be individually recorded sound sources. Furthermore, the audio objects do not have any spatial association and specifically there is no spatial relationship between the different audio objects.

Hence, in contrast to for example a surround sound recording wherein the same sound image (and sound sources) are recorded in different positions to generate different channels of the same spatial signal, the audio objects of the present example are individual and isolated sound sources.

In the teleconferencing application, each audio object corresponds to a speech signal received from one participant in the teleconference call. Thus, the encoder 209 receives audio objects in the form of speech signals received from a plurality of remote communication units taking part in the conference call.

The object oriented encoder 209 encodes the audio objects in a limited number of channels and additionally generates parametric data which allows and facilitates a regeneration of the original audio objects from the generated audio channels at the decoder side. Specifically, the audio encoder 209 can generate a down-mix of the audio objects in a similar way to generating a down mix of a spatial surround sound signal to e.g. a stereo signal. For example, the encoder 209 may generate a down-mix by multiplying the audio object sample values by a down-mix matrix to generate sample values of the down-mix.

The encoder 209 generates a bit stream comprising both the encoding data for the limited number of channels and the associated parametric data. This data is transmitted to the decoder 215.

The decoder 215 comprises in object oriented decoder unit 303 which generates local approximate replicas of the original audio objects based on the received audio channels and the received parametric data. Specifically, the object oriented decoder unit 303 can generate the audio objects by applying an up-mix matrix to the received audio samples. The coefficients of the up-mix matrix are determined in response to the parametric data received from the encoder 209.

The decoder 215 furthermore comprises a rendering unit 305 which is arranged to generate an output signal based on the audio inputs. The rendering unit 305 can freely manipulate and mix the received audio objects to generate a desired output signal. For example, the rendering unit 305 can generate a five channel surround sound signal and can freely position each individual audio object in the generated sound image. As another example, the rendering unit 305 may generate a binaural stereo signal which can provide a spatial experience through e.g. a set of headphones.

In many practical systems, the functionality of the decoding unit 303 and the rendering unit 305 is combined into a single processing step. For example, the operation of the decoding unit 303 typically corresponds to a matrix multiplication by an up-mix matrix and the operation of the rendering unit 305 similarly corresponds to a matrix multiplication performed on the output of the up-mix matrix multiplication. Thus, by combining the up-mix and rendering matrices into a single matrix, the cascaded matrix multiplication can be combined into a single matrix multiplication.

In the specific example, the rendering unit 305 can place each individual speaker of the conference call at a different location in the sound image with the specific location for each speaker being freely selectable for example by a user controlling the rendering unit 305. As another example, if the audio object corresponds to different musical instruments from a piece of music, the user can freely mix, equalize etc the individual instruments as well as freely position them in the sound image. Thus, the described approach allows a high degree of freedom the individual user to manipulate the different audio objects to generate a customized audio output which can be independent of the audio output generated for other users and recipients of the encoded signal from the encoder 209.

However, despite providing a large degree of flexibility by manipulating audio objects in the rendering unit 305, such manipulation can also result in degradation in the quality of the generated audio signal. In particular, in order to generate exact replicas of the audio objects in the decoder 215, it is necessary to apply an up-mix matrix which is the inverse of the down-mix matrix used in the encoder 209. However, this is generally not possible (for example is not possible when the number of generated audio signals is smaller than the number of audio objects as no inverse matrix exists for the down-mix matrix in this case) and accordingly only approximations of the original audio signals can be generated. Specifically, the audio objects generated in the decoder will contain an amount of cross interference from other audio objects. As a result, the manipulation of one audio object will affect the perception and characteristics of another audio object which may result in degraded performance and noticeable artifacts.

In the system of FIG. 3, the encoder 215 is furthermore capable of generating control data in the form of encoding modification data which is transmitted to the encoder 209. The encoding modification data is then evaluated by the encoder 209 which modifies the encoding process depending on the received control information. Specifically, the encoder 209 can modify the down-mixing of the audio objects and the spatial parameters which are generated for the down-mix. As a specific example, the encoding modification data may specify that the volume of one specific audio object should be reduced. Accordingly the encoder 209 reduces the level of this audio object (e.g. prior to or as part of the down-mixing operation) and modifies (directly or indirectly) the parametric data for the audio object such that when the audio objects are decoded at the decoder, the level will be appropriately reduced and preferably such that the modified parametric data correctly represents the change in level for the respective audio object(s).

The approach thus allows for some or all of the object manipulation to be performed at the encoding side. As the encoder has access to the original independent audio objects rather than just to the approximate replicas, an improved performance can be achieved and in particular it may be possible to provide an improved quality. For example, the cross interference is reduced and therefore the impact on the other audio objects of increasing or decreasing the volume of one audio object may be substantially reduced or even removed completely.

Figure 4:
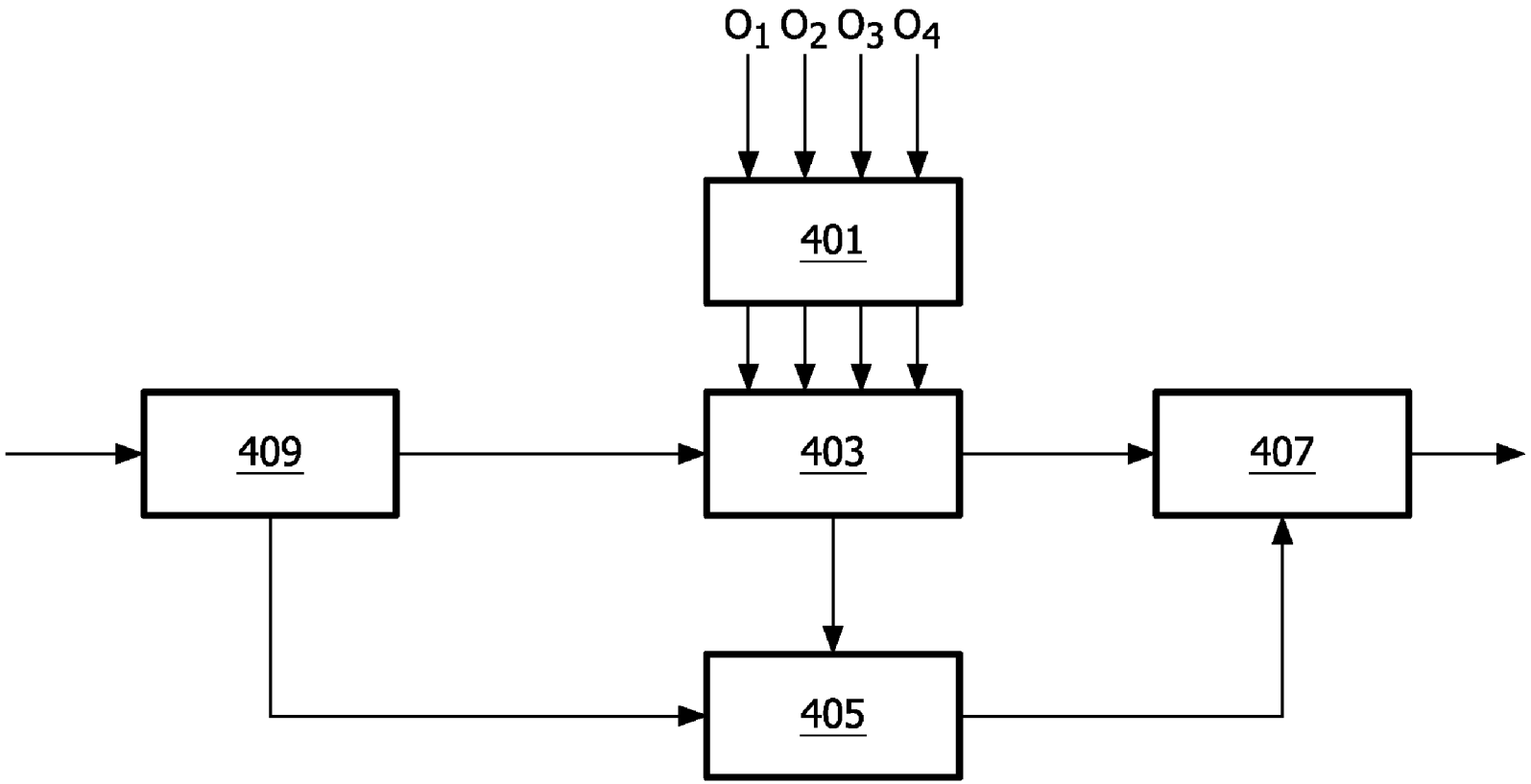
FIG. 4 illustrates an example of an encoder in accordance with some embodiments of the invention.

FIG. 4 illustrates the encoder 209 in more detail. In the following the operation of the encoder 209 will be described in more detail with reference to the specific example where the decoder side generates encoding modification data which is transmitted to the encoder and used to control the relative levels of individual audio objects.

The encoder 209 comprises a receiving unit 401 which receives the audio objects which in this is the case are the speech signals received from remote communication units, such as telephones, taking part in the teleconference call. The speech objects are fed to an encoding unit 403 which down-mixes the objects to a number of audio signals which is lower than the number of speech audio objects. Specifically, the encoding unit 403 performs the matrix multiplication given by:

$$Y=D\times X$$

where X denotes an N dimensional vector comprising the speech object samples (where N is the number of speech objects), Y is an M dimensional vector comprising the down-mix output samples (where M is the number of output channels) and D is an N,M down-mix matrix. M may be significantly lower than N. For example, for a six way teleconference, five speech signals may be down-mixed to a single mono signal which is transmitted to the sixth communication unit.

The encoder 209 furthermore comprises a parameter unit 405 which generates parametric data that can be used to recreate the audio objects from the down-mix signal. Specifically, the parameter unit 405 generates a set of object parameters for each speech object which can be used by the decoder 215 to recreate the speech objects. Ideally, the object parameters would be determined such that an up-mix matrix corresponding to the inverse of the down-mix matrix could be determined i.e. the up-mix matrix $U=D^{-1}$. However, an inverse matrix does not exist for a down-mix matrix (where N>M) and therefore parameter data can only be generated which allows a non-ideal regeneration of the original speech objects.

Accordingly, the parameter unit 405 generates parameters which represent characteristics of the individual speech objects relative to the down-mix signal. In the specific example, the parameter unit first transforms the speech object into the frequency domain in time blocks (e.g. by use of an FFT) and then performs the down-mix matrix multiplication for each time frequency block (or time frequency tile). Furthermore, for the time frequency blocks, the relative amplitude of each speech object relative to the down-mix result is determined. Thus, the parameter unit 405 generates relative level information described in separate time/frequency tiles for the various speech objects. Thereby, a level vector is generated for the time/frequency tiles with each element of the vector representing the amount of energy in the time/frequency tile of the object of that element. This process can result in a set of energy parameters $\sigma_{b,t}^{n}$ for frequency band b, time-segment t, and signal n. These parameters can then be transmitted (preferably in a quantized, logarithmic domain) to the receiving end. Thus, the approach for generating the parameter data may be similar to the approach used for MPEG surround spatial encoding and a reuse of functionality may be achievable in many embodiments.

The parameter unit 405 and the encoding unit 403 are coupled to a transmit processor 407 which generates a bitstream comprising both the encoding data and the parametric data. Specifically, the bit stream may be an MPEG compatible encoded stereo signal with the parametric data comprised in ancillary data portions of the bit stream. The resulting bit stream is then transmitted to the appropriate communication unit.

Figure 5:
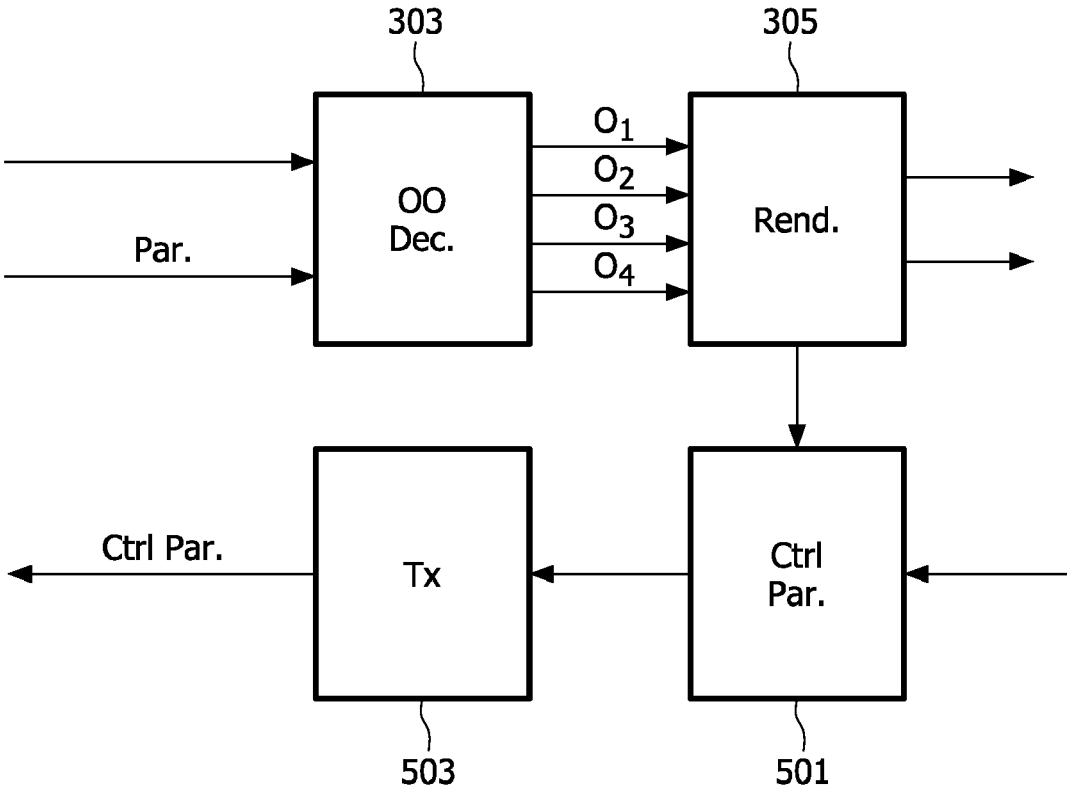
FIG. 5 illustrates an example of a decoder in accordance with some embodiments of the invention.

FIG. 5 illustrates the decoder 215 in more detail. The decoder 215 comprises the object oriented decoding unit 303 which generates approximate replicas of the speech objects. Specifically, the decoding unit 303 can generate time frequency tiles of the individual speech objects by modifying the corresponding time frequency tiles of the received down-mix signal as indicated by the corresponding relative level difference for that object as given in the parametric data.

If the individual speech signal for object n is given by $x^n(t)$, with associated energy parameters $\sigma_{b,t}^{n}$, and a down-mix signal m(t), the decoder-side estimate of speech signal $x^n(t)$ for time/frequency tile (b,t) may be given by:

$$\hat{x}_{b,t}^{n} = m_{b,t}\sqrt{\frac{\sigma_{b,t}^{n}}{\sum_{i}\sigma_{b,t}^{i}}}$$

The speech objects are fed to the rendering unit 305 which can proceed to generate an output signal for the user. Furthermore, in the example, the user may be able to adjust various rendering parameters and characteristics including for example changing a position of one or more of the speech objects in the generated sound image.

In addition, the decoder 215 comprises a control processor 501 which can generate encoding modification data in response to a user input. The encoding modification data is fed to a transmitting unit 503 which transmits the encoding modification data to the encoder 209.

The encoder 209 comprises a control data receiver 409 which receives the encoding modification data. The control data receiver 409 is coupled to the encoding unit 403 and the parameter unit 405 which are arranged to modify the encoding and generation of parameter data depending on the received encoding modification data. Thus, in addition to the control of the rendering of the speech objects at the decoder, the user thereof can also control the encoding operation of the object oriented encoding performed at the encoder side.

As a specific example, the spatial image and the object spatial locations in the generated output signal of the decoder can be controlled by modifying the rendering operation of the decoder whereas (large) volume adjustments can be performed by controlling the down-mixing at the encoder.

Thus, the decoder user may request that the volume of a specific speech object is increased substantially. If this is performed by amplifying the corresponding speech object at the decoder, the amplification will also amplify the cross interference components from other speech objects which may not only result in a higher volume of these but also in distortion of these objects and possibly in a shift in the position of these objects.

However, in accordance with the example, the decoder 215 does not change the scaling of the generated speech object replicas but rather generates encoding modification data which will cause the encoder to modify the down-mix weights for the desired speech objects.

Thus, in the example the disadvantages associated with changing individual audio object levels at the decoder side are mitigated or eliminated by controlling the relative levels at the encoder side. Specifically, the desired level modifications of the user at the decoder side are transmitted to the encoder and are applied as the down-mix weights.

In the teleconferencing example, the receiving end also transmits the locally produced speech back to the teleconferencing hub. Accordingly, this speech signal can be include the down mix weights for all objects that are received by the receiver (or by data that results in the receiver changing the down-mix weights, e.g. a relative attenuation or amplification to be applied to a specific speech object). E.g. if the receiving end produces a signal 'speech 0' and receives signals 'speech 1', 'speech 2' and 'speech 3' from other communication units, it can generate and transmit down mix weights for the objects 'speech 1', 'speech 2', and 'speech 3'. These down mix weights are then used by the teleconference hub to generate the down mix signal for this receiving end.

An advantage of this scheme is that the user has a very high degree of freedom in modifying e.g. the volume or distance of each individual speech signal. Furthermore, the down-mix weights (and other parameters) are likely to be fairly constant across time and therefore the data rate required for the encoding modification data is typically very low.

In some embodiments, the encoder 209 may be arranged to modify at least one of the audio objects prior to the down-mixing being performed. For example, the encoding unit 403 can scale the received audio objects before performing the down-mix matrix multiplication. Thus, if encoding modification data is received which indicates that a specific speech object should be lower, the received signal samples for this object may be multiplied by a factor larger than one. The resulting signal can then be used in the down-mix matrix multiplication to generate the down-mix signal. This approach may allow a fixed down-mix matrix to be used and may specifically allow suitable easy to multiply coefficients to be used (for example the down-mix matrix could contain only unity coefficients thereby effectively reducing the down-mix multiplication to a number of simple additions).

In the example, the determination of the object parameters may be determined based on the modified signals. Thus, the scaled speech objects can also be fed to the parameter unit 405 which can determine the relative levels of the frequency time tiles for the modified signals. This approach will result in the up-mixing process by the decoder generating a speech object having the desired volume level. Thus, in this approach, the modification of the parametric data depending on the encoding modification data is indirect in the sense that the encoding modification data is first used to modify the speech objects and the parameter data is then generated on the basis of the modified speech objects.

In other embodiments, the parametric data may be modified more directly. For example, the speech objects may be fed directly to the parameter unit 405 before any modification is performed. The parameter unit 405 may then determine the relative intensity levels for the different frequency time tiles and subsequently adjust the measured levels in response to the encoding modification data. This modification can be made to match the modification of the speech object prior to the down-mix thereby ensuring a correct generation of the volume compensated speech object at the decoder.

In some embodiments, only the parametric data is changed in response to the encoding modification data and the speech objects and down mixing is maintained unchanged. In this example, the object parameters may be changed such that the decoder will generate the required speech objects by applying the modified object parameters. In this case, in order to modify a given speech object, it may be necessary to not only change the object parameter for that speech object but also for other speech objects.

In some embodiments, the down-mix weights (e.g. the down-mix matrix coefficients) may be changed in response to the received encoding modification data. For example, the volume of a specific speech object may be increased by increasing the down-mix matrix coefficient(s) for that speech object. In this case, a modified speech object signal is typically not available and accordingly the object parameters may be changed directly in response to the encoding data such that they reflect the changed down-mix weights.

It will also be appreciated that in some such embodiments, the modification of one speech object may also affect other speech objects. For example, when changing the down-mix weight of one speech object, the other down-mix weights may be adjusted such that the total energy of the down-mix signal remains unchanged. Alternatively or additionally, the relative energy parameters for frequency time tiles of other speech objects may be modified to reflect a changed energy of the generated down-mix signal.

In some embodiments, the encoding modification data can be frequency specific such that different modification data is provided for different frequencies. For example, rather than just indicating a modified down-mix weight for a given speech object, this down-mix weight may be given as a function of the frequency. Thus, the remote user may not only adjust the gain of a speech object as a whole but may modify the frequency characteristic of the object. This may allow the remote user to efficiently control an equalization operation for the individual speech object. Thus, in the example, at least some of the encoding modification data is provided as a function of frequency and the parameter unit 405 accordingly proceeds to modify the parametric data depending on the frequency.

It will be appreciated that the transmitter 201 may be arranged to generate individual signals for a different decoders. E.g. in the exemplary application of a teleconference hub, the transmitter 201 may receive different encoding modification data from different participants in the teleconference and may generate separate parametric data and down-mix for the individual participants.

In some embodiments, the encoder 209 furthermore comprises functionality for generating the output signal(s) as a spatial down-mix. Thus, in the example, the encoder 209 is arranged to render the speech objects as a spatial output signal wherein each speech object is rendered at a specific location with a specific volume level and frequency characteristic etc. Specifically, the output of the encoder 209 may be a stereo signal, a surround sound multi-channel signal and/or a binaural spatial surround signal e.g. generated using Head Related Transfer Functions.

In such embodiments, the encoding modification data received from the decoder 215 can comprise spatial rendering parameters which affect the rendering of the speech objects in the spatial signal.

The spatial rendering parameters can for example indicate that the position of one or more of the audio objects should be changed in the spatial output mix. As another example, equalization data may be provided which can be applied to an individual audio object. As another example, the perceived distance of each audio object may be remotely controlled from the decoder end. For example, if encoding modification data is received which indicates that an audio object should be moved further away in a spatial down-mix, the rendering of this audio object may be changed such that the volume level is reduced and the correlation between front and back channels is increased. Such modifications are known to affect the perception of distance resulting in the user experiencing the sound source of the audio object being moved further away from the listener.

As another example, the remote user may control the spatial rendering mode of the encoder. For example, for a two-channel output signal, the user can select whether the rendering should be optimized for loudspeakers or headphones. Specifically, the remote user can select whether the output should be generated as a traditional stereo signal or as a binaural spatial surround signal for use with headphones.

Such an approach may provide a number of advantages. For example, the required bit rate for transmitting the spatial rendering parameters is typically relatively low since rendering parameters are only defined per sound source (i.e., they are typically not frequency dependent). Furthermore, these parameters are likely to be fairly constant over time. The required parameters for the decoder-side rendering approach, on the other hand, have to be transmitted for each sound source and for each time/frequency tile, resulting in significant amounts of data to be transmitted. Thus, by moving some or all of the rendering to the encoder side, an efficient audio system can be achieved.

Also improved compatibility with legacy decoders can be achieved. The central encoder can generate a bit stream that is optimized for each decoder independently (i.e., mono, stereo, or surround decoders can all be catered for and the generated signal can be optimized for the specific destination decoder.

The approach may allow additional or enhanced services to be provided. For example, each customer can pay an additional fee for certain rendering possibilities (i.e., level adjustments are a first service level, and spatial rendering may be a second, more expensive service level).

Furthermore, as the rendering requirement for the decoder may be decreased, a reduced complexity of the destination decoder is possible in many applications.

Figure 6:
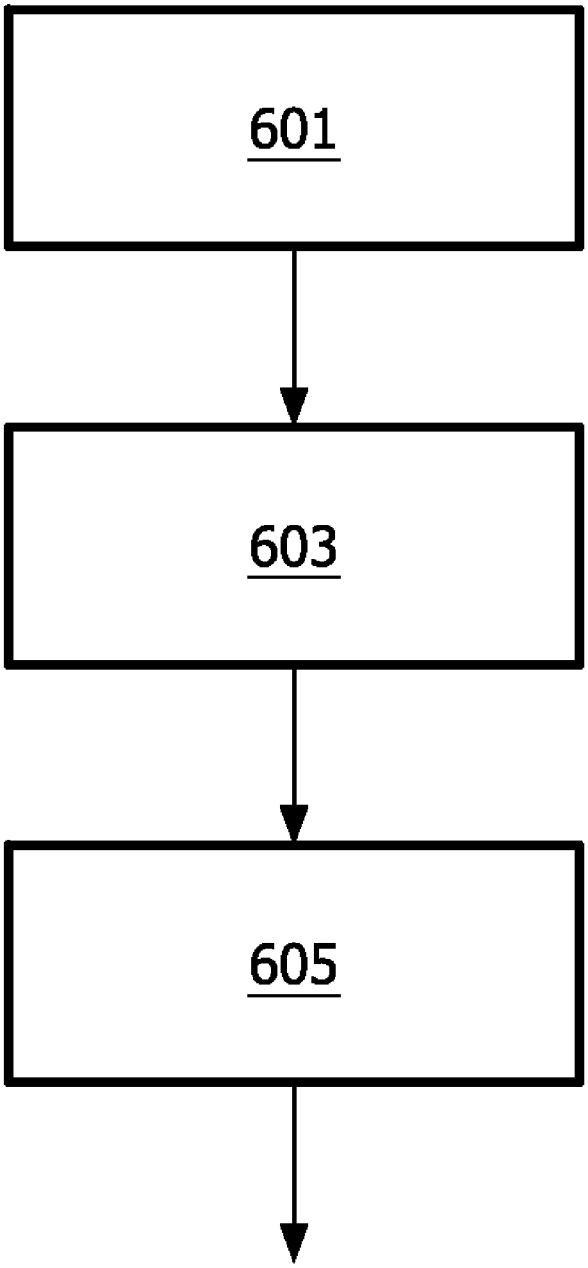
FIG. 6 illustrates an example of a method of encoding audio signals in accordance with some embodiments of the invention.

FIG. 6 illustrates an example of a method of encoding audio signals in accordance with some embodiments of the invention.

The method initiates in step 601 wherein a plurality of audio objects is received.

Step 601 is followed by step 603 wherein encoding modification data is received from a remote unit.

Step 603 is followed by step 605 wherein the plurality of audio objects are encoded in a number of audio signals and parametric data representing the plurality of audio objects relative to the number of audio signals. The parametric data comprises a set of object parameters for each of the different audio objects and is determined in response to the modification data.

Figure 7:
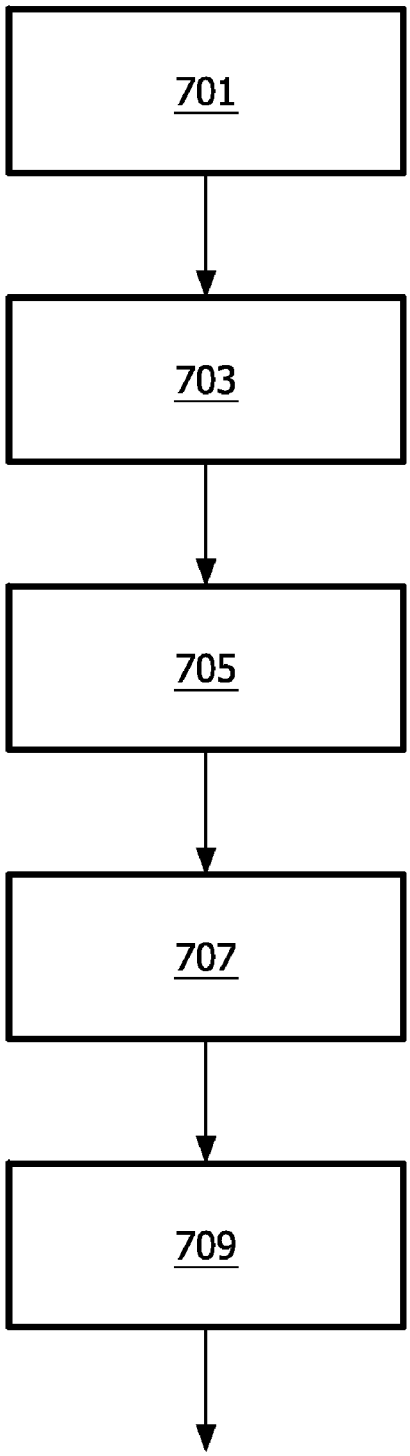
FIG. 7 illustrates an example of a method of decoding audio objects in accordance with some embodiments of the invention.

FIG. 7 illustrates an example of a method of decoding audio objects in accordance with some embodiments of the invention.

The method initiates in step 701 wherein a number of audio signals and parametric data representing the audio objects relative to the number of audio signals is received from an encoder. The audio signals are a down-mix of the audio objects and the parametric data comprises a set of object parameters for each of the different audio objects.

Step 701 is followed by step 703 wherein the audio objects are decoded from the number of audio signals in response to the parametric data.

Step 703 is followed by step 705 wherein a spatial multichannel output signal is generated from the audio objects.

Step 705 is followed by step 707 wherein encoding modification data for the object encoder is generated.

Step 707 is followed by step 709 wherein the encoding modification data is transmitted to the object encoder.

It will be appreciated that the above description for clarity has described embodiments of the invention with reference to different functional units and processors. However, it will be apparent that any suitable distribution of functionality between different functional units or processors may be used without detracting from the invention. For example, functionality illustrated to be performed by separate processors or controllers may be performed by the same processor or controllers. Hence, references to specific functional units are only to be seen as references to suitable means for providing the described functionality rather than indicative of a strict logical or physical structure or organization.

The invention can be implemented in any suitable form including hardware, software, firmware or any combination of these. The invention may optionally be implemented at least partly as computer software running on one or more data processors and/or digital signal processors. The elements and components of an embodiment of the invention may be physically, functionally and logically implemented in any suitable way. Indeed the functionality may be implemented in a single unit, in a plurality of units or as part of other functional units. As such, the invention may be implemented in a single unit or may be physically and functionally distributed between different units and processors.

Although the present invention has been described in connection with some embodiments, it is not intended to be limited to the specific form set forth herein. Rather, the scope of the present invention is limited only by the accompanying claims. Additionally, although a feature may appear to be described in connection with particular embodiments, one skilled in the art would recognize that various features of the described embodiments may be combined in accordance with the invention. In the claims, the term comprising does not exclude the presence of other elements or steps.

Furthermore, although individually listed, a plurality of means, elements or method steps may be implemented by e.g. a single unit or processor. Additionally, although individual features may be included in different claims, these may possibly be advantageously combined, and the inclusion in different claims does not imply that a combination of features is not feasible and/or advantageous. Also the inclusion of a feature in one category of claims does not imply a limitation to this category but rather indicates that the feature is equally applicable to other claim categories as appropriate. Furthermore, the order of features in the claims do not imply any specific order in which the features must be worked and in particular the order of individual steps in a method claim does not imply that the steps must be performed in this order. Rather, the steps may be performed in any suitable order. In addition, singular references do not exclude a plurality. Thus references to "a", "an", "first", "second" etc do not preclude a plurality. Reference signs in the claims are provided merely as a clarifying example shall not be construed as limiting the scope of the claims in any way.

The invention claimed is:

1. An encoder for encoding audio objects, the encoder comprising:

means for receiving a plurality of audio objects;

encoding means for encoding the plurality of audio objects in a number of audio signals and parametric data representing the plurality of audio objects relative to the number of audio signals, the parametric data comprising a set of object parameters for at least one of the different audio objects;

means for receiving encoding modification data from a remote unit; and parameter means for determining the parametric data in response to the encoding modification data.

2. The encoder of claim 1 wherein the encoding means is arranged to generate the number of audio signals by a down-mix of the audio objects and the parameter means is arranged to modify a down-mix weight of at least one of the audio objects in response to the encoding modification data.

3. The encoder of claim 1 wherein the parameter means is arranged to scale at least a first audio object in response to the encoding modification data and to modify object parameters for the first audio object in response to the scaling.

4. The encoder of claim 1 wherein at least some of the encoding modification data is frequency specific and the parameter means is arranged to determine at least one object parameter in response to a frequency characteristic of the object parameter.

5. The encoder of claim 1 wherein the encoding means is arranged to modify at least one audio object in response to the encoding modification data prior to a down-mix of the audio objects to the number of audio signals.

6. The encoder of claim 1 wherein the encoding means is arranged to generate the number of audio signals as a spatial down-mix.

7. The encoder of claim 6 wherein the encoding means is arranged to modify in response to the encoding modification data at least one characteristic selected from the group consisting of:

a spatial location of at least one of the audio objects;

a distance characteristic of at least one of the audio objects;

a spatial rendering mode of the encoder, and a frequency characteristic of at least one of the audio objects.

8. The encoder of claim 1 wherein each audio object is associated with a set of audio sources which are independent of audio sources of other audio objects.

9. The encoder of claim 1 wherein the encoder is arranged to receive a first audio object from the remote unit and the means for receiving the encoding modification data is arranged to extract the encoding modification data from encoding data received for the first audio object.

10. The encoder of claim 1 wherein the encoder is arranged to receive encoding modification data from a plurality of remote units and to generate different parametric data for the different remote units in response to receiving different encoding modification data from the different remote units.

11. A decoder for decoding audio objects, the decoder comprising:

a receiver for receiving from an encoder a number of audio signals being a down-mix of a plurality of audio objects and parametric data representing the plurality of audio objects relative to the number of audio signals, the parametric data comprising a set of object parameters for at least one of the different audio objects;

decoding means for decoding the audio objects from the number of audio signals in response to the parametric data;

rendering means for generating a spatial multi-channel output signal from the audio objects;

means for generating encoding modification data for the an object encoder; and means for transmitting the encoding modification data to the object encoder.

12. An audio playing device comprising a decoder according to claim 11.

13. A teleconference hub for supporting a teleconference between a plurality of communication units, the teleconference hub comprising:

means for receiving a first plurality of speech signals from the plurality of communication units;

encoding means for encoding for a first communication unit the first plurality of speech signals in a number of audio signals and parametric data representing the plurality of speech signals relative to the number of audio signals, the parametric data comprising a set of object parameters for at least one of the different speech signals;

means for receiving encoding modification data from the first communication unit; and parameter means for determining the parametric data in response to the modification data; and means for transmitting the number of audio signals and parametric data to the first communication unit.

14. A transmitter for transmitting audio signals, the transmitter comprising:

means for receiving a plurality of audio objects;

encoding means for encoding the plurality of audio objects in a number of audio signals and parametric data representing the plurality of audio objects relative to the number of audio signals, the parametric data comprising a set of object parameters for at least one of the different audio objects;

means for receiving encoding modification data from a remote unit; and parameter means for determining the parametric data in response to the modification data.

15. A receiver for receiving audio signals, the receiver comprising:

a receiver element for receiving from an encoder a number of audio signals being a down-mix of a plurality of audio objects and parametric data representing the plurality of audio objects relative to the number of audio signals, the parametric data comprising a set of object parameters for at least one of the different audio objects;

decoding means for decoding the audio objects from the number of audio signals in response to the parametric data;

rendering means for generating a spatial multi-channel output signal from the audio objects;

means for generating encoding modification data for the object encoder; and means for transmitting the encoding modification data to the object encoder.

16. A communication system for communicating audio signals, the communication system comprising:

a transmitter comprising:

means for receiving a plurality of audio objects, encoding means for encoding the plurality of audio objects in a number of audio signals and parametric data representing the plurality of audio objects relative to the number of audio signals, the parametric data comprising a set of object parameters for at least one of the different audio objects, and means for transmitting the number of audio signals and the parametric data to a receiver; and the receiver comprising:

a receiver element for receiving from the transmitter the number of audio signals and the parametric data, decoding means for decoding the audio objects from the number of audio signals in response to the parametric data, rendering means for generating a spatial multi-channel output signal from the audio objects, means for generating encoding modification data for the encoding means, and means for transmitting the encoding modification data to the transmitter;

and wherein the transmitter comprises means for receiving the encoding modification data from the receiver;

parameter means for determining the parametric data in response to the encoding modification data.

17. A method of encoding audio signals, the method comprising:

receiving a plurality of audio objects at an input;

in an encoding unit connected to the input, encoding the plurality of audio objects to transform them into a number of audio signals, and in a parametric data generator, determining parametric data representing the plurality of audio objects relative to the number of audio signals, the parametric data comprising a set of object parameters for at least one of the plurality of audio objects;

receiving encoding modification data from a remote unit; and wherein the parametric data are determined in response to the encoding modification data in the parametric data generator.

18. A non-transitory computer storage media comprising a program for controlling a processor for executing the method of claim 17.

19. A method of decoding audio signals, the method comprising:

receiving from an object encoder a number of audio signals being a down-mix of a plurality of audio objects and parametric data representing the plurality of audio objects relative to the number of audio signals, the parametric data comprising a set of object parameters for at least one of the different audio objects at an input;

in a decoding unit connected to the input, decoding the audio objects from the number of audio signals in response to the parametric data;

generating a spatial multi-channel output signal from the audio objects;

generating encoding modification data for the object encoder; and transmitting the encoding modification data to the object encoder.

20. A non-transitory computer storage media for controlling a processor for executing the method of claim 19.

21. A method of transmitting audio signals, the method comprising:

receiving a plurality of audio objects;

encoding the plurality of audio objects in a number of audio signals and parametric data representing the plurality of audio objects relative to the number of audio signals, the parametric data comprising a set of object parameters for at least one of the different audio objects;

receiving coding modification data from a remote unit;

determining the parametric data in response to the encoding modification data, and transmitting the number of audio signals and parametric data.

22. A method of receiving audio signals, the method comprising:

receiving from an encoder a number of audio signals being a down-mix of a plurality of audio objects and parametric data representing the plurality of audio objects relative to the number of audio signals, the parametric data comprising a set of object parameters for at least one of the different audio objects;

decoding the audio objects from the number of audio signals in response to the parametric data;

generating a spatial multi-channel output signal from the audio objects;

generating encoding modification data for the object encoder; and transmitting the encoding modification data to the object encoder.

23. A method of transmitting and receiving audio signals, the method comprising:

a transmitter performing the steps of receiving a plurality of audio objects, encoding the plurality of audio objects in a number of audio signals and parametric data representing the plurality of audio objects relative to the number of audio signals, the parametric data comprising a set of object parameters for at least one of the different audio objects, and transmitting the number of audio signals and the parametric data to a receiver; and the receiver performing the steps of:

receiving from the transmitter the number of audio signals and the parametric data;

decoding the audio objects from the number of audio signals in response to the parametric data;

generating a spatial multi-channel output signal from the audio objects;

generating encoding modification data for the encoding means; and transmitting the encoding modification data to the object, encoder;

and wherein the transmitter further performs the steps of:

receiving the encoding modification data from the receiver, and determining the parametric data in response to the encoding modification data.

24. An encoder for encoding audio objects, the encoder comprising:

an input for receiving a plurality of audio objects;

an encoder unit communicating with the input to encode the plurality of audio objects into a number of audio signals and to determine parametric data representing the plurality of audio objects relative to the number of audio signals, the parametric data comprising a set of object parameters for at least one of the different audio objects;

a receiver element to receive encoding modification data; and wherein, the encoder unit determines the parametric data in response to the encoding modification data.

25. A decoder for decoding audio objects, the decoder comprising:

a receiver element that receives a number of audio signals being a down-mix of a plurality of audio objects and parametric data representing the plurality of audio objects relative to the number of audio signals, the parametric data comprising a set of object parameters for at least one of the different audio objects;

a decoder unit connected to the receiver element to decode the audio objects from the number of audio signals in response to the parametric data;

a rendering unit connected to the decoding unit to generate a spatial multi-channel output signal from the audio objects;

a generator unit connected to the decoder unit to generate encoding modification data for the object encoder; and a transmitter element connected to the generator unit for transmitting the encoding modification data.

26. A decoder for decoding audio objects, the decoder comprising:

a receiver element that receives a number of audio signals being a down-mix of a plurality of audio objects and parametric data representing the plurality of audio objects relative to the number of audio signals, the parametric data comprising a set of object parameters for at least one of the different audio objects;

a decoder unit connected to the receiver element to decode the audio objects from the number of audio signals in response to the parametric data and to generate encoding modification data for the object encoder;

a rendering unit connected to the decoding unit to generate a spatial multi-channel output signal from the audio objects; and a transmitter element connected to the generator unit for transmitting the encoding modification data.

27. A teleconference hub for supporting a teleconference between a plurality of communication units, the teleconference hub comprising:

an input to receive a first plurality of speech signals from the plurality of communication units;

an encoder for a first communication unit, the encoder being connected to the input to encode the first plurality of speech signals into a number of audio signals and to generate parametric data representing the plurality of speech signals relative to the number of audio signals, the parametric data comprising a set of object parameters for at least one of the different speech signals;

a receiver to receive encoding modification data from the first communication unit; and a parameter generator to determine the parametric data in response to the modification data; and one or more outputs to transmit the number of audio signals and parametric data to the first communication unit.

28. A transmitter for transmitting audio signals, the transmitter comprising:

a receiver unit that receives a plurality of audio objects;

an encoder unit connected to the receiver unit to encode the plurality of audio objects into a number of audio signals and to determine parametric data representing the plurality of audio objects relative to the number of audio signals, the parametric data comprising a set of object parameters for at least one of the different audio objects;

a receiver element to receive encoding modification data; and wherein the encoder unit determines the parametric data in response to the modification data one or more outputs to transmit the number of audio signals and parametric data.

29. A receiver for receiving audio signals, the receiver comprising:

one or more inputs to receive a number of audio signals being a down-mix of a plurality of audio objects and parametric data representing the plurality of audio objects relative to the number of audio signals, the parametric data comprising a set of object parameters for a least one of the different audio objects;

a. decoding unit connected to the inputs to decode the audio objects from the number of audio signals in response to the parametric data;

a rendering unit to generate a spatial multi-channel output signal from the audio objects;

a generator connected to the decoding unit or rendering unit to generate encoding modification data for the object encoder; and a transmitter element connected to the generator for transmitting the encoding modification data to the object encoder.

30. A communication system for communicating audio signals, the communication system comprising:

a transmitter comprising:

a receiver unit that receives a plurality of audio objects, an encoder element connected to the receiver unit to encode the plurality of audio objects into a number of audio signals and to generate parametric data representing the plurality of audio objects relative to the number of audio signals, the parametric data comprising a set of object parameters for at least one of the different audio objects, and a transmitter element connected to the encoder element to transmit the number of audio signals and the parametric data to a receiver; and the receiver comprising:

a receiver element to receive from the transmitter the number of audio signals and the parametric data, a decoding unit connected to the receiver to decode the audio objects from the number of audio signals in response to the parametric data, a rendering unit connected to the decoding unit to generate a spatial multi-channel output signal from the audio objects, a generating unit connected to the decoding unit or the rendering unit to generate encoding modification data to control the encoding of the encoder element, and a transmitting unit connected to the generating unit for transmitting the encoding modification data to the transmitter;

and wherein the transmitter comprises:

an input for receiving the encoding modification data from the receiver; and wherein the encoder generates the parametric data in response to the encoding modification data.

* * * * *